US005320023A

United States Patent [19]

Erdem

[11] Patent Number: 5,320,023

[45] Date of Patent: Jun. 14, 1994

[54] SEMIAUTOMATIC PISTOL

[76] Inventor: S. Alper Erdem, PK 409, Sirkeci, Istanbul, Turkey

[21] Appl. No.: 8,152

[22] Filed: Jan. 25, 1993

[51] Int. Cl.[5] ..... F41A 3/66

[52] U.S. Cl. ..... 89/195; 42/7; 89/146

[58] Field of Search ..... 42/7, 22, 69.03, 71.02; 89/139, 146, 194, 195, 199

[56] References Cited

U.S. PATENT DOCUMENTS 2,655,839 10/1953 Ruger ..... 89/146
3,318,192 5/1967 Miller et al. ..... 89/199
4,358,986 11/1982 Giorgio ..... 89/199

FOREIGN PATENT DOCUMENTS 413162 8/1910 France ..... 89/195

*Primary Examiner*—Stephen C. Bentley
*Attorney, Agent, or Firm*—E. Michael Combs

[57] ABSTRACT

A semi-automatic piston construction of blow-back type configuration to effect directing of projectiles from within includes construction of the pistol to employ application of the breech bolt within the upper receiver, with a return spring arrangement mounted to the breech bolt in an axially spaced and parallel relationship relative to the firing pin. The upper receiver includes a generally U-shaped trough projecting from the receiver into the handle portion of the lower receiver to accommodate the main spring and magazine holder structure.

2 Claims, 4 Drawing Sheets

SEMIAUTOMATIC PISTOL

BACKGROUND OF THE INVENTION

1. Field of the Invention

The field of invention relates to automatic pistol construction, and more particularly pertains to a new and improved semi-automatic pistol wherein the same employs limited components in construction to provide for increased longevity and ease of construction of the pistol structure.

2. Description of the Prior Art

Automatic pistols and semi-automatic pistols of various construction are utilized throughout the prior art. Typically, pistols to fire cartridges of limited cartridge size are employed, such as in the firing of 22 and 25 type caliber cartridges. Prior art structure is exemplified in the U.S. Pat. Nos. 4,825,744; 4,420,899; 4,934,244; 4,803,911; and 4,926,739.

Such prior art structures have been utilized in the construction of automatic pistols of various types of a direct blow-back and semi-locked breech bolt design.

The instant invention attempts to overcome deficiencies of the prior art by providing for a construction utilizing a limited amount of constructional components to increase efficiency as well as employing inherent safety feature in the direct disconnect of the pistol sear relative to the pistol hammer.

SUMMARY OF THE INVENTION

In view of the foregoing disadvantages inherent in the known types of semi-automatic pistol apparatus now present in the prior art, the present invention provides a semi-automatic pistol employing a straight trigger bar release of the sear relative to the hammer to provide for increased trigger tension to provide for inherent safety in utilization of the organization, as well as the structure arranged of limited components for longevity and ease of construction. As such, the general purpose of the present invention, which will be described subsequently in greater detail, is to provide a new and improved semi-automatic pistol which has all the advantages of the prior art semi-automatic pistol apparatus and none of the disadvantages.

To attain this, the present invention provides a semi-automatic pistol construction of a blow-back type configuration to effect directing of projectiles from within, including construction of the pistol to employ application of the breech bolt within the upper receiver, with a return spring arrangement mounted to the breach bolt in an axially spaced and parallel relationship relative to the firing pin. The upper receiver includes a generally U-shaped trough projecting from the receiver into the handle portion of the lower receiver to accommodate the main spring and magazine holder structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved semi-automatic pistol which has all the advantages of the prior art semi-automatic pistol apparatus and none of the disadvantages.

It is another object of the present invention to provide a new and improved semi-automatic pistol which may be easily and efficiently manufactured and marketed.

It is a further object of the present invention to provide a new and improved semi-automatic pistol which is of a durable and reliable construction.

An even further object of the present invention is to provide a new and improved semi-automatic pistol which is susceptible of a low cost of manufacture with regard to both materials and labor, and which accordingly is then susceptible of low prices of sale to the consuming public, thereby making such semi-automatic pistols economically available to the buying public.

Still yet another object of the present invention is to provide a new and improved semi-automatic pistol which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
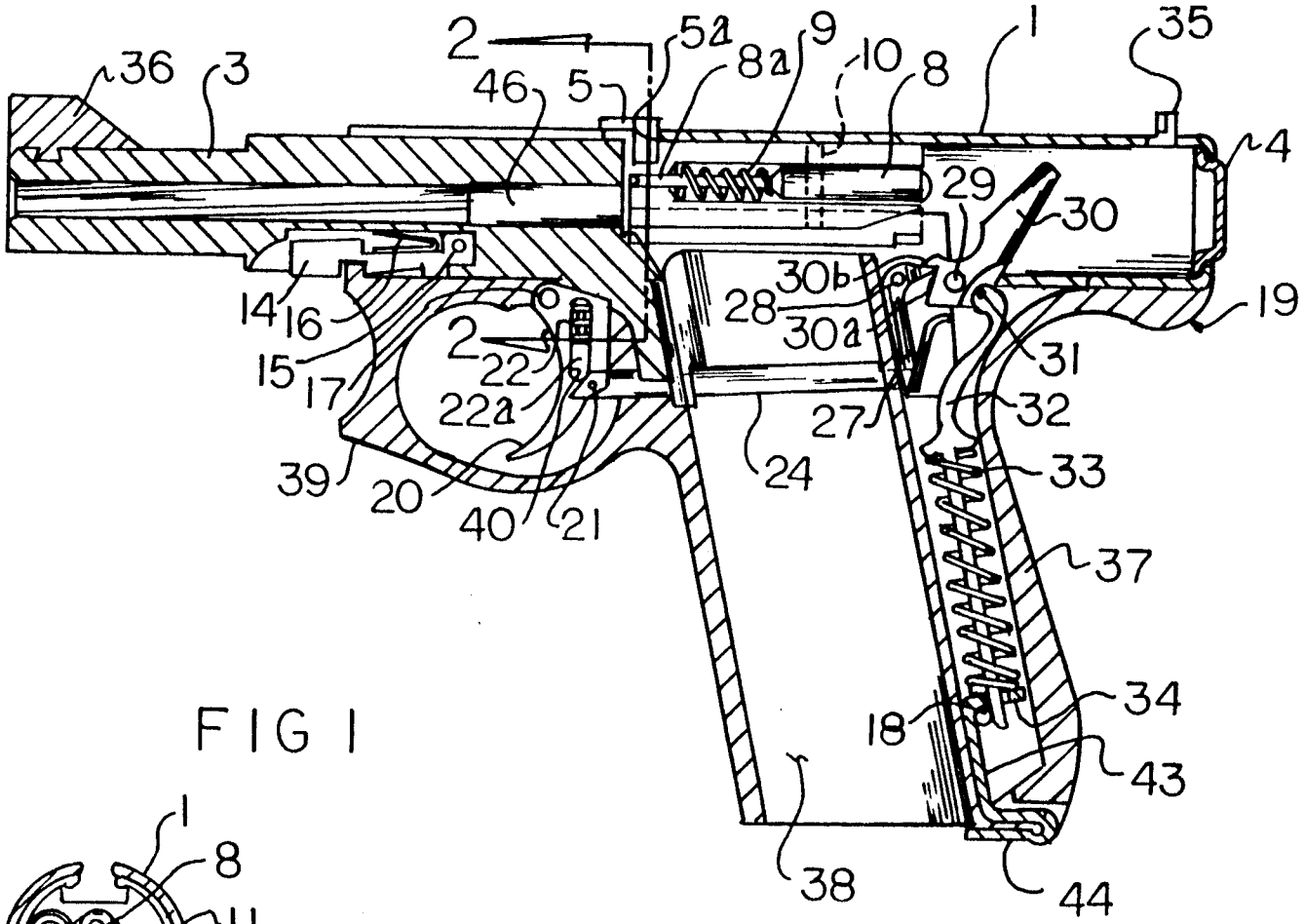
FIG. 1 is an orthographic cross-sectional illustration of the pistol construction of the invention.
Figure 2:
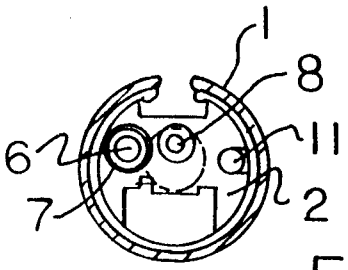
FIG. 2 is an orthographic view, taken along the lines 2—2 of FIG. 1 in the direction indicated by the arrows.

With reference now to the drawings, and in particular to FIGS. 1 to 5 thereof, a new and improved semi-automatic pistol embodying the principles and concepts of the present invention and generally designated by the reference numeral 50 will be described.

More specifically, the semi-automatic pistol 50 of the instant invention essentially comprises a rigid upper receiver 1 of tubular construction, having an eject port 48 laterally of the receiver, and an L-shaped guide slot 49 coaxially parallel to an axis "A" of the upper receiver displaced substantially ninety degrees relative to the eject port 48. A breech bolt 2 is slidably mounted within the receiver, having a breech bolt cocking handle slot 5*a* positioned within the breech bolt adjacent a forward end thereof to receive a cocking handle 5 fixedly mounted within the breech bolt, and more specifically within the cocking handle slot 5*a*, with the cocking handle 5 slidably mounted within the guide slot 49. In this manner, grasping of the cocking handle 5 permits manual reciprocation of the breech bolt to a cocking orientation. A barrel 3 oriented along the axis "A" is mounted to the upper receiver utilizing take-down lever axle 15 directed through the barrel and directed simultaneously through a take-down lever 14 that is arranged with a forward abutment head overlying a forward end of the lower receiver 19 and biased into engagement with the lower receiver 19 by a take-down lever spring 16 captured between the take-down lever 14 and the barrel 3, in a manner as indicated in the FIGS. 1 and 3. Rotation of the take-down lever about the take-down lever axle 15 permits selective removal of the barrel relative to the pistol assembly.

Figure 3:
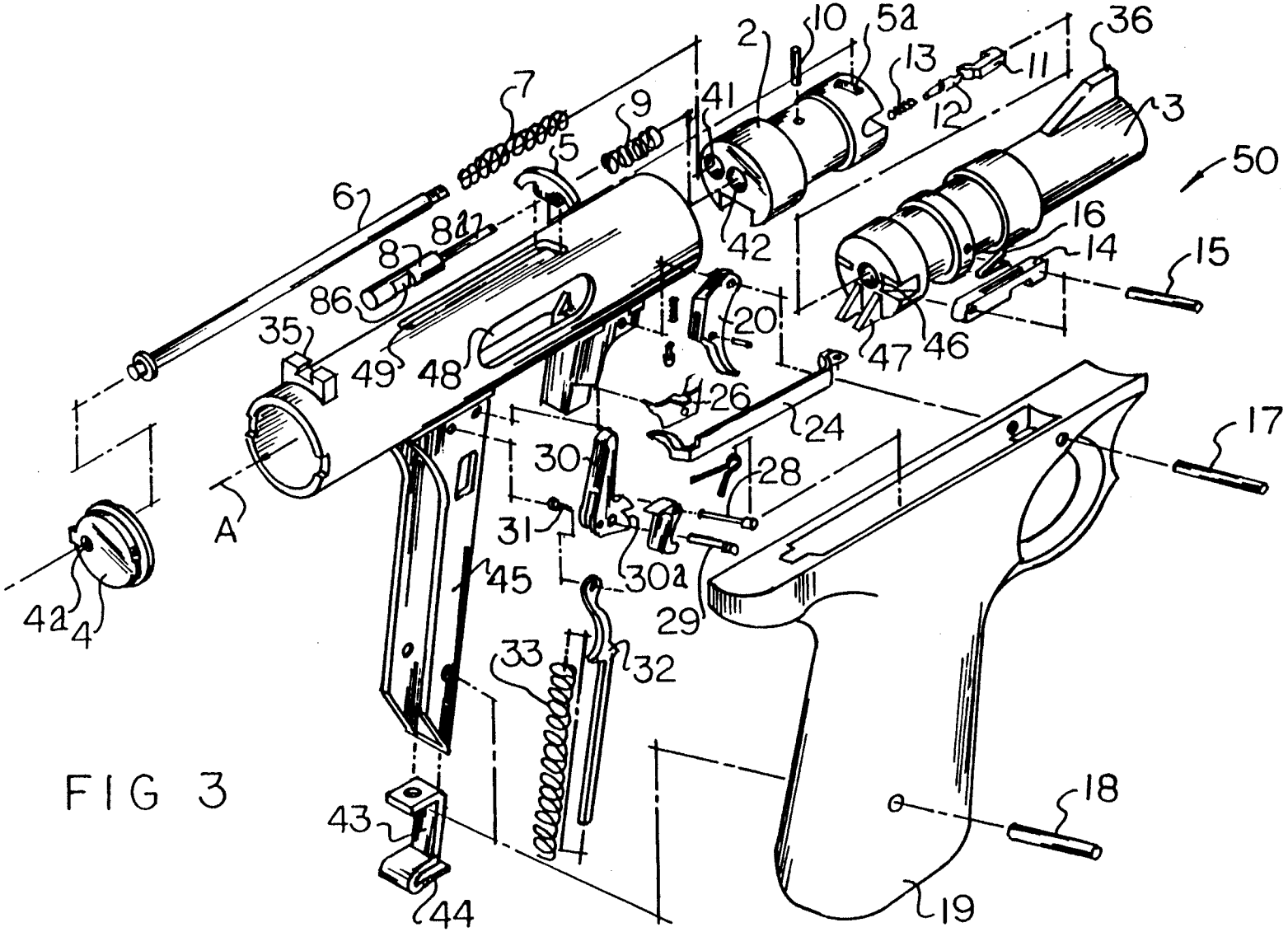
FIG. 3 is an isometric exploded view of the invention.
Figure 4:
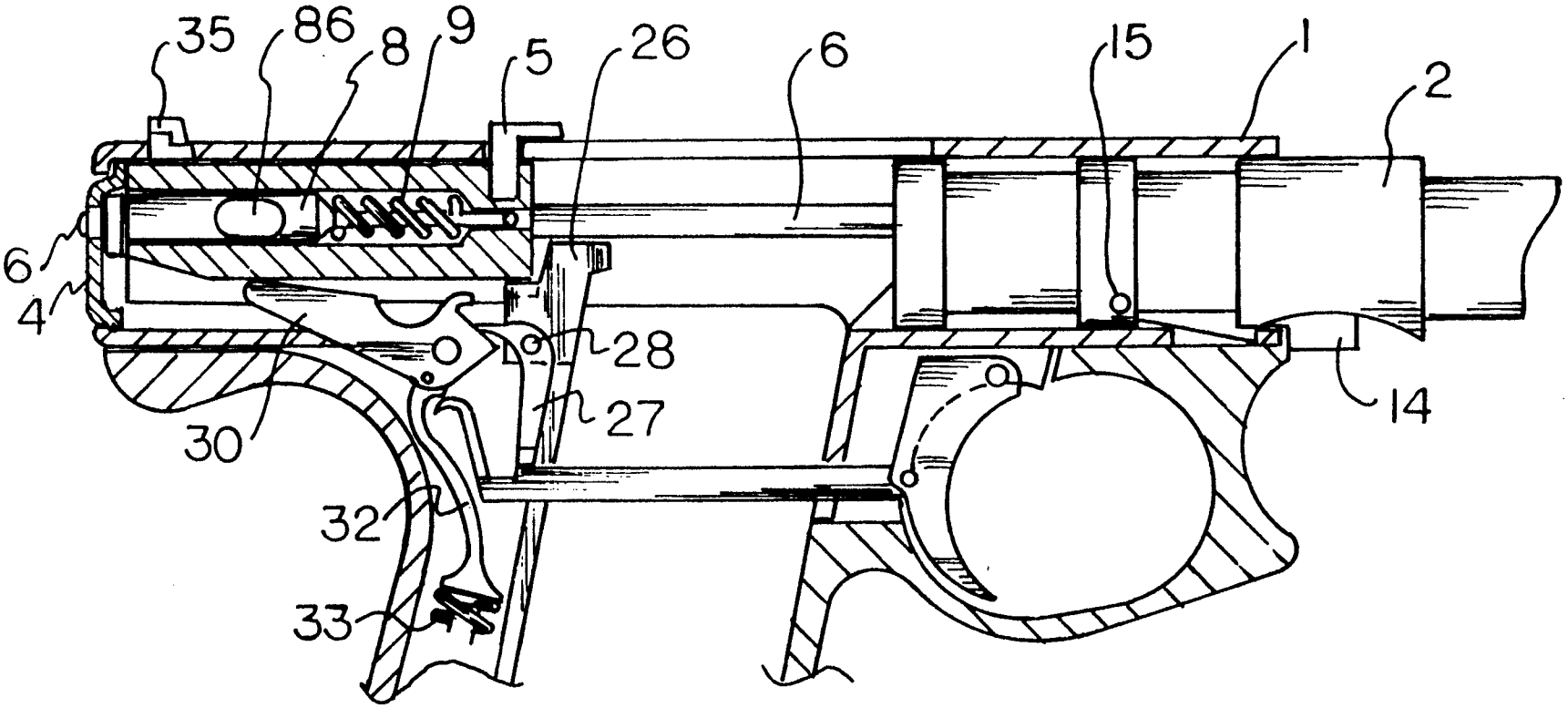
FIG. 4 is an orthographic view of the breech bolt in a retracted orientation relative to the barrel.
Figure 5:
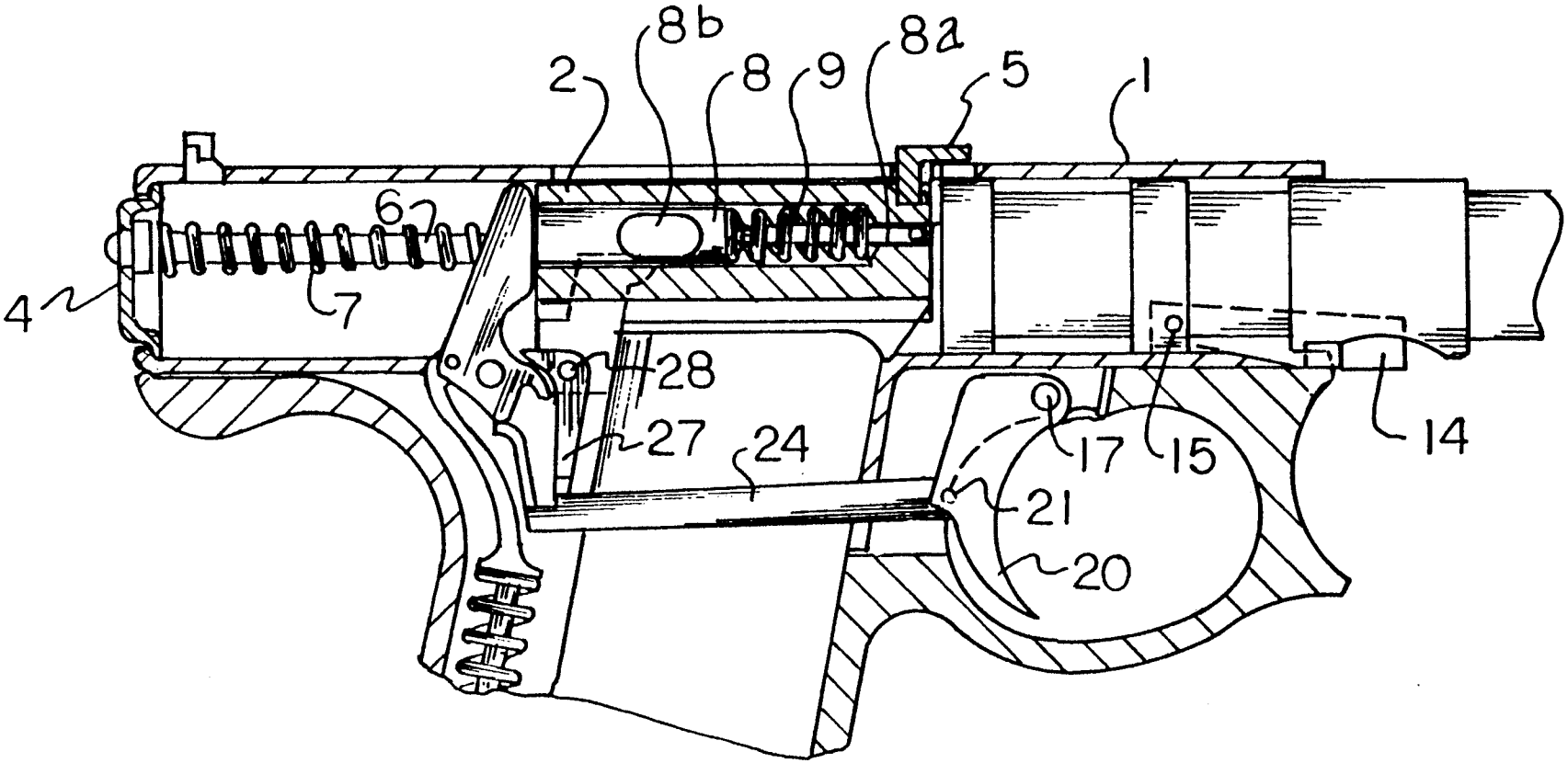
FIG. 5 is an orthographic view of the pistol construction indicating the breech bolt in the forward orientation relative to the barrel and the hammer in communication with the firing pin mechanism.

The breech bolt 2 includes a rear face having a recess 41 receiving the forward end of a recoil spring guide 6, with the rear end of the recoil spring guide 6 received within a shield bore 4*a* of a recoil shield 4 fixedly mounted to a rear distal end of the upper receiver 1 to bias the breech bolt in a forward orientation. A recoil spring 7 is wound about the guide and captured between the rear face of the breech bolt and the shield 4, in a manner as indicated in FIG. 5. The breech bolt includes a breech bolt bore 42 parallel and offset with the axis "A" receiving a firing pin rod 8*a* therethrough, having a rear end integrally mounting a firing pin head 8, with the firing pin head 8 having a firing pin head recess 8*b* that receives a firing pin stop pin 10 orthogonally relative thereto, wherein the firing pin stop pin 10 directed through the breech bolt to position in an axially sliding relationship the firing pin head 8 relative to the breech bolt 2 (see FIGS. 3 and 1). An extractor 11 biased forwardly by an extractor plunger 12 that captures the extractor spring 13 between the extractor plunger and a forward end of the breech bolt face, as indicated in FIG. 3, for operative communication of a cartridge head directed into the barrel bore 46. A rear face of the barrel bore 46 includes a feed ramp 47 below the barrel bore, and extractor slot in adjacency to the barrel bore to receive the extractor 11.

A lower receiver 19 houses a trigger 20 pivotally about a trigger axle 17 below the barrel 3. The trigger includes a trigger spring 22 having a trigger spring plunger 22*a* at its forward end mounted within a trigger spring plunger well within the trigger biasing the trigger downwardly in communication with a forward end of a trigger bar 24. The trigger bar 24 extends in adjacency to a magazine well 38 directed into a lower receiver handle 37 of the lower receiver 19. The lower receiver handle 37, and more specifically the magazine well 38, receives an automatic pistol magazine of a type known in the prior art and exemplified in U.S. Pat. No. 4,420,899 incorporated herein by reference. The upper receiver 1 includes a receiver U-shaped trough 45 directed downwardly therefrom, with the trough having sear 27 pivotally mounted about a sear axle 28 within the trough 45 in adjacency to the upper receiver 1. A hammer 30 pivotally mounted about a hammer axle pin 29 includes a hammer engaging nose 30*a* arranged for engagement with the sear 27, with the hammer nose 30*a* including a hammer abutment flange 30*b* to engage the sear in a cocked orientation of the hammer 30, in a manner as indicated in FIG. 1. A main spring 33 is wound about a hammer strut 32 that has its lower end mounted within a magazine latch flange 34 and having its upper end pivotally mounted about a hammer strut axle 31 directed into a lower end of the hammer 30 in adjacency to the hammer axle 29. Rearward projection of the trigger bar 24 abuts a lower end of the sear 27 to displace the sear relative to the hammer 30 permitting the hammer 30 to engage the firing pin head 8 directing the firing pin 8 forwardly into engagement with a cartridge (not shown) positioned within the barrel bore 46, and more specifically the barrel bore chamber portion of the barrel bore directed into a rear end face of the barrel 3.

The magazine latch flange 34 includes a magazine latch leg 43 directed downwardly therefrom along the U-shaped trough 45 terminating in a magazine latch plate 44 projecting below the magazine well 38 to engage a lower end of a magazine (not shown) for securing such magazine within the magazine well 38. A magazine latch axis pin 18 is directed through the lower receiver 19 and below the magazine latch flange 34 between the magazine latch flange 34 and the magazine latch plate 44.

The receiver is formed of a steel tube construction as indicated devoid of required forgings, with the barrel and breech bolt formed typically on a lathe and as understood, may be formed of a unitary forging, with turning for finishing for ease of construction. A rear sight 35, as well as a front sight 36, are aligned and mounted to respective upper receiver and barrel respectively for unitary construction. A limited number of components are required in the construction of the invention, and typically such components require only thirty-six individual parts to include the front and rear sights. The upper receiver tubular construction guides the breech bolt and accordingly requires no additional stamping and alignment of guide rails and the like for the alignment and guidance of the breech bolt within the construction. The longer travel of the trigger 20 as well as the engagement of the hammer strut 32 and main spring 33 with the hammer 30 effects increased resistance against rearward retraction of the trigger 20 requiring inherent safety of the device in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A semi-automatic pistol, comprising, an upper receiver and a lower receiver, the lower receiver having a handle projecting downwardly therefrom, and a trigger guard, with the upper receiver formed of a tubular configuration having a rearward end and a forward end, the forward end slidably receiving therethrough a breech bolt, and a barrel mounted to the upper receiver, with the breech bolt oriented between the barrel and the upper receiver rear end, and the upper receiver rear end including a recoil shield, with the upper receiver oriented about an axis, and the shield, the upper receiver, and the breech bolt symmetrically oriented about the axis, with the breech bolt having a breech bolt rear face, and the breech bolt rear face including a first bore, with the first bore slidably receiving a recoil spring guide therethrough, and a recoil spring oriented between the breech bolt rear face and the recoil shield, the breech bolt having a second bore, with the second bore and the barrel having a barrel bore in operative relationship to the second bore, and a firing pin head slidably mounted within the breech bore second bore, the firing pin head having a firing pin head recess, with a firing pin stop pin directed through the breech bolt intersecting the firing pin head recess, with the firing pin stop pin orthogonally oriented relative to the axis, and the firing pin head having a firing pin rod extending from the firing pin head through a forward face of the breech bolt, and the upper receiver includes a U-shaped trough fixedly mounted to the upper receiver extending downwardly therefrom directed into the lower receiver and into the lower receiver handle, and a magazine latch leg mounted within the lower receiver, and a magazine latch pin directed through the lower receiver handle in abutment with the magazine latch leg, with the magazine latch leg having a magazine latch flange, with the magazine latch pin oriented in an intersection of the magazine latch flange and the magazine latch leg, and the magazine latch leg further including a magazine latch plate positioned in adjacency to a lower distal end of the handle, with the handle having a magazine well directed into the handle from a lower distal end of the handle, and the magazine latch plate positioned into an orientation below the magazine well, and a hammer strut shaft extending from the hammer strut through the magazine latch flange, with a main spring captured between the hammer strut and the magazine latch flange wound about the hammer strut shaft, and a hammer pivotally mounted within the U-shaped trough adjacent an upper distal end of the U-shaped trough, with the hammer having a hammer axle pivotally mounting the hammer within the U-shaped trough, and the hammer further including a hammer strut axle pivotally mounting the hammer strut to the hammer, and the hammer having a hammer nose, and a hammer sear, with the sear pivotally mounted about a sear pin, with the sear pin directed through the U-shaped flange in adjacency to the hammer nose, and the hammer having a hammer abutment flange for selective engagement with the sear, and a trigger bar arranged for engagement with the sear, and the trigger bar extending through the lower receiver, and a trigger pivotally mounted within the trigger guard, and the trigger having a trigger well, the trigger well including a trigger spring, and a trigger spring plunger, with the trigger spring plunger arranged for engagement with the trigger bar, and the trigger bar including a trigger bar axle pivotally mounting the trigger bar to the trigger permitting displacement of the sear relative to the hammer nose upon pivoting of the trigger.

2. A pistol as set forth in claim 1 wherein the breech bolt includes a breech bolt slot, and the upper receiver includes an upper receiver slot, and a cocking handle fixedly mounted within the breech bolt slot slidably mounted within the upper receiver slot, and an ejector opening directed through the upper receiver between the upper receiver slot and the U-shaped slot.

* * * * *